US010270145B1

(12) United States Patent
Antipov et al.

(10) Patent No.: US 10,270,145 B1
(45) Date of Patent: Apr. 23, 2019

(54) MICROWAVE POWER EXTRACTOR COMPRISING A PARTIALLY DIELECTRIC LOADED WAVEGUIDE CONFIGURED TO PROVIDE A CONVERTED MODE ENERGY OUTPUT

(71) Applicant: Euclid Techlabs LLC, Gaithersburg, IL (US)

(72) Inventors: Sergey Antipov, Naperville, IL (US); Chunuang Jing, Naperville, IL (US); Roman Kostin, Naperville, IL (US); Jiaqu Qiu, Willowbrook, IL (US); Dan Wang, Willowbrook, IL (US); Alexei Kanareykin, Gaitherstburg, MD (US); Stanislauv Baturin, Naperville, IL (US); Sergey Baryshev, Lemont, IL (US)

(73) Assignee: EUCLID TECH LABS, LLC, Gaithersburg, MD (US)

( * ) Notice: Subject to any disclaimer, the term of this patent is extended or adjusted under 35 U.S.C. 154(b) by 33 days.

(21) Appl. No.: 15/413,443

(22) Filed: Jan. 24, 2017

Related U.S. Application Data

(60) Provisional application No. 62/286,382, filed on Jan. 24, 2016.

(51) Int. Cl.
*H01P 1/16* (2006.01)
*H01P 3/16* (2006.01)
(Continued)

(52) U.S. Cl.
CPC ..... *H01P 1/16* (2013.01); *H01P 3/122* (2013.01); *H01P 3/127* (2013.01); *H01P 3/16* (2013.01);
(Continued)

(58) Field of Classification Search
CPC ..... H01P 1/16; H01P 3/122; H01Q 5/087; H01Q 13/06; H01Q 13/20; H01Q 13/24; H01Q 13/28
(Continued)

(56) References Cited

U.S. PATENT DOCUMENTS 2,509,196 A * 5/1950 Cork et al. ..... H01Q 13/24 333/34
2,761,137 A * 8/1956 Van Atta et al. ..... H01P 3/122 333/237
(Continued)

*Primary Examiner* — Benny Lee
(74) *Attorney, Agent, or Firm* — John D Gugliotta

(57) ABSTRACT

A technique is presented to extract electromagnetic radiation from a dielectric loaded waveguide consisting of a layer or layers of dielectric material enclosed in a metallic conducting jacket. The electromagnetic radiation generated in the dielectric waveguide by a charged particle beam or otherwise generated as input to the waveguide. Dielectric loaded waveguides used for generation (or transport) of electromagnetic radiation at frequencies above 100 GHz have dimensions in the sub-mm range. Due to difficulty in the fabrication of a conventional broadband horn-like antenna to extract electromagnetic radiation from the structure because of the large impedance mismatch between the dielectric loaded waveguide and free space, the designing and fabricating aperture of antennas are formed as part of the dielectric waveguide and utilizes an angle cut or a set of apertures machined into the dielectric loaded waveguide to ensure broadband power extraction with minimal return loss and high directivity.

15 Claims, 2 Drawing Sheets

(51) Int. Cl.

| | |
|---|---|
| ***H01P 3/127*** | (2006.01) |
| ***H01P 3/12*** | (2006.01) |
| ***H01Q 13/24*** | (2006.01) |
| ***H01Q 13/06*** | (2006.01) |
| ***H01Q 13/20*** | (2006.01) |

(52) U.S. Cl.
CPC ..... *H01Q 13/06* (2013.01); *H01Q 13/20* (2013.01); *H01Q 13/24* (2013.01)

(58) Field of Classification Search
USPC ..... 333/21 R, 248
See application file for complete search history.

(56) References Cited

U.S. PATENT DOCUMENTS 2,822,542 A * 2/1958 Butterfield ..... H01Q 1/286 343/705
4,825,221 A * 4/1989 Suzuki et al. ..... H01P 3/16 333/239
5,734,303 A * 3/1998 Baca ..... H01P 1/16 315/5

* cited by examiner

MICROWAVE POWER EXTRACTOR COMPRISING A PARTIALLY DIELECTRIC LOADED WAVEGUIDE CONFIGURED TO PROVIDE A CONVERTED MODE ENERGY OUTPUT

RELATED APPLICATIONS

The present invention claims the benefit of U.S. Provisional Application No. 62/286,382, filed on Jan. 24, 2016 and incorporated by reference as if fully rewritten herein.

BACKGROUND OF THE INVENTION

1. Field of the Invention

The present invention is in the technical field of microwave and THz waveguides that are used to generate or transport EM radiation. The invention provides the means for mode conversion and power extraction from a waveguide partially loaded with dielectric into free space in a desired output mode, using an antenna machined as an integral part of the waveguide.

2. Description of the Related Art

Recently there has been a growing interest in utilizing dielectric loaded waveguides for high frequency RF power generation in the 100 GHz to 3 THz frequency range. At these frequencies, dielectric loaded structure dimensions are in the sub-millimeter range for these applications. Currently used geometries for TM01 mode extraction from dielectric loaded waveguides become increasingly difficult to machine accurately. Use of a dielectric taper is a broadband solution, but for dielectric waveguides in this frequency range it is practically impossible. A broadband solution which can be efficiently manufactured is needed.

The principal application of this technology is the efficient generation of microwave and THz beams for basic research, medical diagnostic imaging and advanced radars.

The invention presented here effectively develops a technique to efficiently extract RF energy from a dielectric waveguide by machining the end of the waveguide at an angle with respect to the waveguide axis or introducing a system of apertures machined into the waveguide.

Further, the far field pattern of the radiated RF energy is controlled by the angled or tilted end cut or the system of apertures and can be selected by appropriate design.

Further still, existing methods for extracting RF energy from a cylindrical dielectric waveguide either are inefficient or require high precision machining of complicated geometries.

Further still, the present invention allows for control of the radiated RF characteristics through introduction of electrically controlled nonlinear dielectric elements.

The approaches described in this section could be pursued, but are not necessarily approaches that have been previously conceived or pursued.

Therefore, unless otherwise indicated herein, the approaches described in this section are not prior art to the claims in this application and are not admitted to be prior art by inclusion in this section.

The present invention is a technique for extracting the RF energy of a waveguide mode in a dielectric structure that is manufacturable, efficient, and allows control of the far field radiation pattern.

SUMMARY OF THE INVENTION

Briefly described according to a broad embodiment of the present invention, this technology is a low-cost mode converter/power extractor which provides the capability to radiate a highly directive pencil beam of microwave energy from devices that produce or transport such microwaves in a dielectric loaded waveguide (cylindrical, or rectangular, partially loaded with dielectric). While radiation of the TM01 mode from a cylindrical dielectric beam with a null on axis is not practical for many applications, the proposed extraction method provides an efficient conversion to the free-space fundamental TEM Gauss-Hermite or Gauss-Laguerre modes. The key part for providing the low-cost solution is the simplicity of the fabrication required for producing such a converter in which a straight cut or an array of drilled holes are provided, instead of horn-like shapes, which are notoriously hard to machine in dielectric materials like ceramics, quartz, sapphire, etc.

By appropriate design of the power extractor geometry (angle of the angle cut, step size of the step cut, angle of the pencil cut, periodicity and diameters for the side wall hole array) 99% of the microwave energy in a mode will radiate out in a form of a highly directed Gaussian wave beam.

According to one aspect of the present invention, a power extractor for a microwave system is able to receive microwave energy in the form of a TM01 mode of a cylindrical dielectric loaded waveguide. In such a configuration, the output energy is predominantly in the form of a TEM Gauss-Laguerre mode with high directivity and minimal reflection.

According to another aspect of the present invention, a power extractor for a cylindrical dielectric waveguide is provided that consists of a modification of the waveguide by introduction of an angled cut made at the end of the waveguide.

According to another aspect, the power extractor for a cylindrical dielectric waveguide consists of a modification of the waveguide by a step cut made at the end of the waveguide.

According to another aspect of the present invention, a power extractor for a cylindrical dielectric waveguide is provided that consists of a modification of the waveguide by introduction of a series of apertures penetrating through the side wall of the waveguide.

According to yet another aspect of the present invention, a power extractor for a cylindrical dielectric waveguide is provided that consists of a modification of the waveguide by forming the dielectric at the end of the waveguide into a truncated conical shape.

According to yet another aspect of the present invention, a power extractor for a cylindrical dielectric waveguide is provided that incorporates both angled end cuts and apertures in order to allow two transverse magnetic (TM) modes to be extracted simultaneously from two different ports, while preserving the spectral purity of each mode. In yet another aspect, a power extractor for a dielectric waveguide may incorporate both the step cut and the apertures, thereby allowing two TM modes to be extracted simultaneously.

In still yet another aspect of the present invention, a power extractor for a dielectric waveguide that incorporates both the truncated conical end and the apertures that allows two TM modes to be extracted simultaneously.

According to yet another aspect of the present invention, a power extractor for a microwave system able to receive microwave energy in the form of an LSM mode of a rectangular dielectric loaded waveguide and output this energy predominantly in the form of a Gauss-Hermite mode (fundamental TE mode) with high directivity and minimal reflection.

According to yet other aspects of the present invention, a power extractor for a dielectric waveguide is provided in either cylindrical or rectangular configurations from an elongated linear centerline.

Further aspects of the present invention provide a power extractor for cylindrical or rectangular dielectric waveguides that consists of a modification of the waveguide by forming the dielectric at the end of the waveguide into a wedge shapes, angled cuts, step cuts, sidewall aperture, and combinations that allows two TM or LSM modes to be extracted simultaneously from two different ports while preserving the spectral purity of each mode.

Further objects, features, aspects and advantages will become apparent in the course of the following description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

FIGS. 1A, 1B, 1C, 1D and 1E depicts a cylindrical waveguide of different configurations for the radiator geometry, specifically: FIG. 1[B] Conical cut; FIG. 1[C] angle cut; FIG. 1[D] transverse slots; and FIG. 1[E] transverse slots combined with angle cut to radiate two separate frequencies. In each figure the arrow represents the approximate direction of the radiated signal.

DESCRIPTION OF THE PREFERRED EMBODIMENTS

The best mode for carrying out the invention is presented in terms of its preferred embodiment, herein depicted within FIGS. 1A through 1E and FIG. 2. It should be understood that the legal scope of the description is defined by the words of the claims set forth at the end of this patent and that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

It should also be understood that, unless a term is expressly defined in this patent there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112(f).

The best mode for carrying out the invention is presented in terms of its preferred embodiment, herein depicted within the Figures.

1. Detailed Description of the Figures

Figure 1:
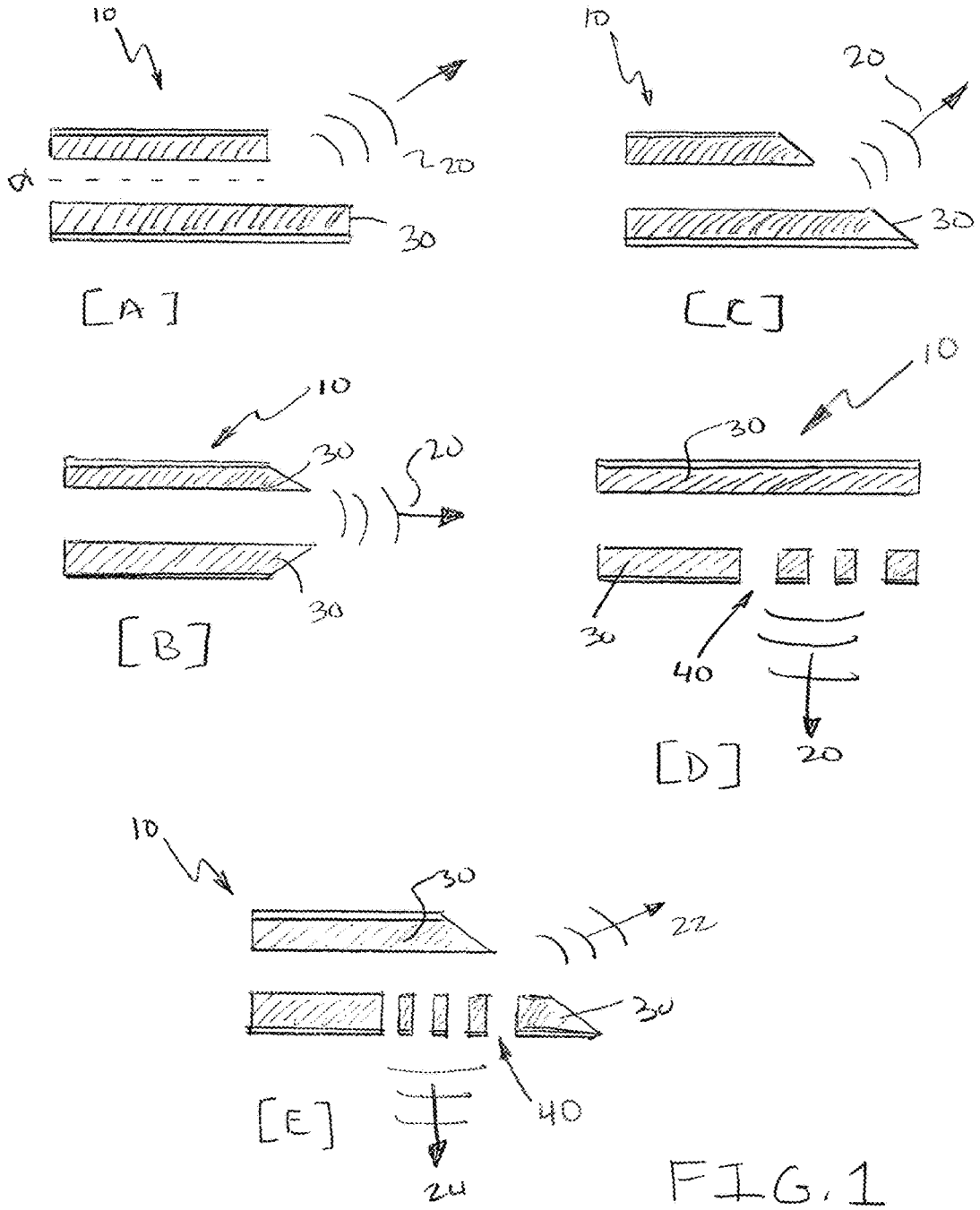
FIG. 1[A] Step cut.

Referring now to FIGS. 1A through 1E, the present invention provides a low-cost mode converter/power extractor which provides the capability to radiate a highly directive pencil beam "α" (FIG. 1A) of microwave energy from devices that produce or transport such microwaves in a partially dielectric loaded waveguide (cylindrical, or rectangular, partially loaded with dielectric). Radiation of the TM01 mode (from a cylindrical partially-dielectric loaded waveguide) from conventional aperture devices produces a low directivity annular beam with a null on an axis which is not practical for applications. According to the present invention, such a proposed extraction method provides an efficient conversion to the free-spaced fundamental TEM Mode. As shown in reference to FIGS. 1A through 1E, a waveguide, generally noted as 10, is shown in various cylindrical configurations. These various configurations for the cylindrical radiator geometry include:

Step cut, as shown in FIG. 1 [A], wherein the centerline is the axis of rotation prior to the cut(s) being made; Conical cut, as shown in FIG. 1[B]; Angle cut, as shown in FIG. 1[C]; Transverse slots, as shown in FIG. 1[D]; and Transverse slots combined with angle cut, as shown in FIG. 1 [E], in which radiation radiates at two separate frequency signals 20 (FIGS. 1A through 1D), 22 (FIG. 1E). In each figure the arrow represents the approximate direction of the radiated signal 20, 22.

As shown throughout FIGS. 1A through 1E, each configuration of waveguide 10 is adapted for providing a low-cost solution configuration through the simplicity of the fabrication required for producing such a converter. Fabrication includes step cuts (FIG. 1A), conical cuts (FIG. 1B), angled cuts (FIG. 1C, FIG. 1E) or straight cuts (FIG. 1D), or an array of drilled holes 40 (FIG. 1D), or a combination of both straight cuts and holes 40 (FIG. 1E). Such fabrication technique are more cost effective to utilized as compared to prior art configurations such as of horn-like shapes, which are notoriously hard to machine in metallized coated dielectric materials 30 like ceramics, quartz, sapphire etc.

Figure 2:
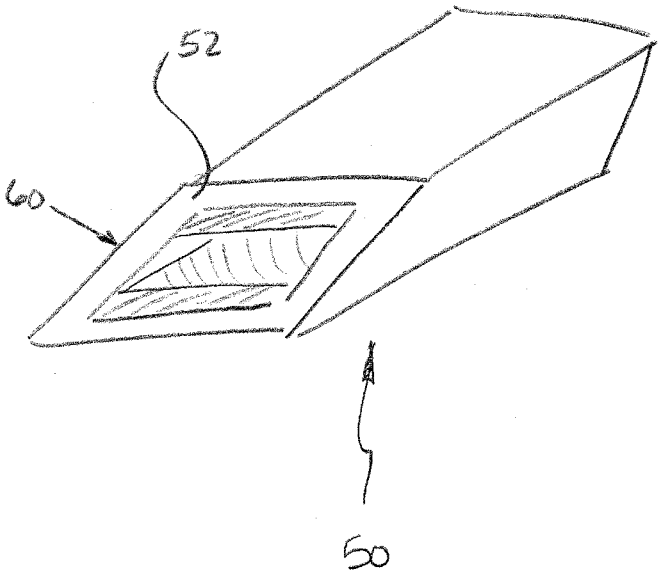
FIG. 2 depicts a rectangular geometry waveguide showing an angle cut configuration.

Referring in conjunction with FIG. 2, an alternate rectangular geometry configuration of a waveguide 50 is shown having an angle cut configuration 60. The rectangular waveguide 50 utilizes conductor materials as outer sidewalls 52 lined in an oriented manner with dielectric such as ceramic, quartz, sapphire or the like. It should be apparent to a person having ordinary skill in the relative art, in conjunction with and in light of the present teachings, that such a rectangular configuration is merely exemplary of alternate linear geometries, and all such alternates may be formed with angled cuts. step cuts, wholes or other configurations analogous to the cylindrical configurations of FIG. 1 above.

2. Operation of the Preferred Embodiment

The application of this technology is in microwave power handling in mm, sub-mm and THz frequency range for use in communications, radar, remote sensing and other industries. In accordance with a preferred embodiment, the aim of said invention is to enable efficient microwave power extraction from dielectric loaded waveguide into free space in mm, sub-mm and THz frequency range.

By appropriate design of the power extractor geometry (angle of the angle cut, step size of the step cut, angle of the pencil cut, periodicity and diameters for the side wall hole array) 99% of the microwave energy in a mode will radiate out in a form of highly directed Gaussian wave beam.

The application of this technology is in microwave power handling in mm, sub-mm and THz frequency range for use in communications, radar, remote sensing and other industries. In accordance with a preferred embodiment, the aim of the invention is to enable efficient microwave power extraction from dielectric loaded waveguide into free space in mm, sub-mm and THz frequency range.

The foregoing descriptions of specific embodiments of the present invention are presented for purposes of illustration and description. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as are suited to the particular use contemplated. It is intended that a scope of the invention be defined broadly by the Drawings and Specification appended hereto and to their equivalents. Therefore, the scope of the invention is in no way to be limited only by any adverse inference under the rulings of *Warner-Jenkinson Company*, v. *Hilton Davis Chemical,* 520 US 17 (1997) or *Festo Corp.* v. *Shoketsu Kinzoku Kogyo Kabushiki Co.,* 535 U.S. 722 (2002), or other similar case-law or subsequent precedent should not be made if any future claims are added or amended subsequent to this Patent Application.

What is claimed is:

1. A power extractor for a microwave system able to receive microwave energy comprising:

a cylindrical partially dielectric loaded waveguide with high directivity and minimal reflection;

a metallized outer surface of said cylindrical partially dielectric loaded waveguide; and an energy output is in a form selected from a group comprising: a Gauss-Laguerre mode; and a Gauss-Hermite mode.

2. The power extractor of claim 1, wherein said cylindrical partially dielectric loaded waveguide further comprises an end an angled cut.

3. The power extractor of claim 1, wherein said metallized outer surface of said cylindrical partially dielectric loaded waveguide further comprises a sidewall forming a series of apertures penetrating through said side wall.

4. The power extractor of claim 1, wherein said cylindrical partially dielectric loaded waveguide further comprises an end forming a step cut.

5. The power extractor of claim 1, wherein the cylindrical partially dielectric loaded waveguide further comprises a dielectric end forming a truncated conical shape.

6. The power extractor of claim 1, wherein said cylindrical partially dielectric loaded waveguide further comprises:

an end of said cylindrical dielectric waveguide forming an angled cut; and a side wall formed from said metallized outer surface of said cylindrical dielectric waveguide forming a series of apertures penetrating the side wall;

wherein two TM modes are extracted simultaneously from different apertures of said series of apertures while preserving the spectral purity of each of said TM modes.

7. The power extractor of claim 1, wherein said cylindrical partially dielectric loaded waveguide further comprises:

a side wall formed from said metallized outer surface of said cylindrical partially dielectric loaded waveguide forming a series of apertures penetrating the side wall; and an end of said cylindrical dielectric waveguide forming a step cut;

wherein two TM modes are extracted simultaneously.

8. The power extractor of claim 1, wherein said cylindrical partially dielectric loaded waveguide further comprises:

a side wall formed from said metallized outer surface of said cylindrical partially dielectric loaded waveguide forming a series of apertures penetrating through the side wall; and an end of said cylindrical partially dielectric loaded waveguide forming a dielectric having a truncated conical shape;

wherein two TM modes are extracted simultaneously.

9. A power extractor for a microwave system able to receive microwave energy comprising:

at least one LSM mode of a rectangular partially dielectric loaded waveguide having high directivity and minimal reflection; and an output energy in a form selected from a group comprising: a Gauss-Hermite mode;

and a Gauss-Laguerre mode.

10. The power extractor of claim 9, wherein said rectangular partially dielectric loaded waveguide further comprises:

an end forming an angled cut.

11. The power extractor of claim 9, wherein said rectangular partially dielectric loaded waveguide further comprises a side wall forming a series of apertures penetrating through the side wall.

12. The power extractor of claim 9, wherein said rectangular partially dielectric loaded waveguide further comprises an end forming a step cut.

13. The power extractor of claim 9, wherein said rectangular partially dielectric loaded waveguide further comprises an end forming a wedge shape.

14. The power extractor of claim 9, wherein said rectangular dielectric waveguide further comprises:

an end forming an angled cut; and a sidewall forming a series of apertures penetrating through the sidewall;

wherein said at least one LSM mode comprises two LSM modes which are extracted simultaneously from two different apertures of said series of apertures while preserving a spectral purity of each of said two LSM modes.

15. The power extractor of claim 9, wherein said partially dielectric loaded waveguide further comprises:

a sidewall forming a series of apertures penetrating through the side wall of the waveguide; and an end forming a wedge shape;

wherein said at least one TM mode comprises two TM modes which are extracted simultaneously.

* * * * *